US005197397A

United States Patent [19]

Yamagishi et al.

[11] Patent Number: 5,197,397

[45] Date of Patent: Mar. 30, 1993

[54] GRATE STRUCTURE FOR A HORIZONTAL TYPE INCINERATOR

[75] Inventors: Miki Yamagishi; Sadao Suzuki; Shigeyuki Doi, all of Kawasaki, Japan

[73] Assignee: NKK Corporation, Tokyo, Japan

[21] Appl. No.: 683,433

[22] Filed: Apr. 11, 1991

[30] Foreign Application Priority Data

May 21, 1990 [JP] Japan ..... 2-52232

[51] Int. Cl.[5] ..... F23B 1/22

[52] U.S. Cl. ..... 110/281; 110/282; 110/283; 110/291; 126/175; 126/167

[58] Field of Search ..... 432/77, 78; 110/268, 110/281-284; 126/167, 175

[56] References Cited

U.S. PATENT DOCUMENTS

| | | | |
|---|---|---|---|
| 945,469 | 1/1910 | Mapel | 110/281 |
| 1,346,464 | 7/1920 | Roach | 110/283 |
| 2,250,067 | 7/1941 | Martin | 110/282 |
| 3,985,084 | 10/1976 | Delaplace | 110/281 |
| 4,510,873 | 4/1985 | Shigaki | 110/283 |
| 4,895,084 | 1/1990 | Kroon et al. | 110/282 |
| 4,913,067 | 4/1990 | Gaskin et al. | 110/291 |

FOREIGN PATENT DOCUMENTS

| | | |
|---|---|---|
| 0003601 | 8/1979 | European Pat. Off. . |
| 0103202 | 3/1984 | European Pat. Off. . |
| 0165432 | 12/1985 | European Pat. Off. . |
| 0288597 | 11/1988 | European Pat. Off. . |
| 911317 | 9/1953 | Fed. Rep. of Germany . |
| 2238392 | 2/1975 | France . |
| 884190 | 12/1961 | United Kingdom . |
| 1223668 | 3/1971 | United Kingdom . |

*Primary Examiner*—Henry C. Yuen
*Attorney, Agent, or Firm*—Keck, Mahin & Cate

[57] ABSTRACT

A grate structure for a horizontal type incinerator has a plurality of rows of grates arranged in parallel in perpendicular X and Y directions of the incinerator. Each X-direction row has a series of immovable grates and a series of movable grates alternating with the immovable grates. The immovable grates and movable grates are supported at a predetermined angle of $\theta_1$ relative to a surface of the immovable supporting member. The immovable grates are pivotally mounted on an immovable support and the movable grates are pivotally mounted on a sawtooth shaped movable support. The free forward end of each grate rests on the adjacent grate. The movable grates are reciprocated back and forth along the upper surfaces of the immovable grates. In the Y direction, each row of grates is pivoted on a common axle by way of a common bearing member.

12 Claims, 3 Drawing Sheets

GRATE STRUCTURE FOR A HORIZONTAL TYPE INCINERATOR

BACKGROUND OF THE INVENTION

The present invention relates to a grate structure for a horizontal type incinerator particularly for incinerating refuse.

DESCRIPTION OF THE RELATED ART

A horizontal incinerator having a plurality of grates in the breadth direction of the incinerator and a plurality of grates in the length direction of the incinerator in the horizontal type incinerator is known. In this incinerator, each grate in each row of the grates is freely rotationally supported by an axis at one end of the grate, and other end of the grate is supported on a grate positioned in the next horizontal row. A groove at the end of each grate opens downwardly to rest on the above-mentioned axis so that each grate can rotate independently.

A plurality of grates constituting one of the rows of the grates can slide on immovable grates in the longitudinal direction of the incinerator, and refuse to be incinerated is successively moved from the inlet side to the outlet side of the incinerator.

A passage referred to as a wind box, which has openings in the lower face and in the lateral face of each grate, is formed. Combustion air is taken into each grate from the lower face of the grate to cool the grate. The inside of the grate is divided into a plurality of spaces, which are connected to each other and range in the form of a shuttle movement, by means of partition walls to form a long air flow path.

In the prior art incinerator of the above-mentioned structure, wear of the surfaces of the grates where the grates slide, or up-and-down movements of the grates which are generated by materials such as molten metals having adhered to the grates can be absorbed by rotatinal motion of the aforementioned axis. When the up-and-down movements exceed an allowed value, the grate can be changed for a new grate by easily removing the grate from the axis by lifting the grate.

The grate can be cooled by taking the combustion air supplied from below into the hollow of the grate through the inlet in the lower face of the grate, causing the combustion air to flow through the hollow and to flow out of the hollow through the outlet in the lateral face of the grate.

In the grate structure of the prior art incinerator, however, since the grates arranged in a plurality of rows in the direction of the breadth of the incinerator are mounted on an axis for movement separately from each other, differences in the up-and-down movements of the grates caused by friction on the surfaces of the grates where the grates slide and by attachments such as molten metals are liable to occur depending on each grate, by which the friction of the axis is liable to be unequal. Accordingly, not only an inclination of the grates, but also a difference in level of the surfaces of the grates may occur. In consequence, gaps are formed among the grates. Moreover, since the gaps are unequal for each grate, there may occur a problem that any good combustion cannot be obtained.

When adhesion of the attachments to the grate during the sliding of the grate is large, a moment is generated in the direction wherein the grate rises from the grate with a position of the attachments as a supporting point. Accordingly, said grate is designed to have a large size and a large weight so that said grate cannot be easily raised by the aforementioned moment due to a reaction force. In consequence, when the grates have to be often changed because of the attachments, work for changing the grates becomes difficult, which raises a problem of increase of costs.

The grates are effectively cooled since a long air flow path is formed through the grates. However, since the air flow path has a form of a shuttle movement in the direction of the breadth of the incinerator or in the longitudinal direction of the incinerator, and the air flows into the end of the grate, to which the attachments adhere, from only a part of the grate relative to the direction of the breadth of the incinerator, the front portion of the grate where the temperature of the grate rises most may be insufficiently cooled. This gives rise to ineffective operation of the grate due to the adhesion of molten metal to the grate or burning of the grate at the end of the grate, on which the movements of the grates produce little influence, by which a combustion state in the incinerator becomes worse due to a decrease of the function of the grates.

SUMMARY OF THE INVENTION

The present invention is intended to solve the aforementioned problems and it is an object of the present invention to provide a grate structure of an incinerator which can supply uniform and stable combustion air without causing substantial damage or gaps between the grates, which are caused by the attachments, even during a long time operation of the incinerator, which enables to prevent the grates from getting out of place, and which interferes with the growth of the attachments.

To attain the aforementioned object, the present invention provides a grate structure for a horizontal type incinerator, comprising:

a grate structure for a horizontal type incinerator, comprising:

a plurality of rows of grates arranged in parallel in perpendicular X and Y directions of the incinerator;

each X-direction row including a plurality of immovable grates in series in the X direction; and a plurality of movable grates arranged in series in the X direction alternating with the immovable grates;

an immovable support member for the immovable grates;

a movable support member for the movable grates;

a bearing member, for each Y-direction row of grates positioned between the grates and an axle extending in the Y direction and which is common to each of the grates in the Y-direction row, the bearing member and axle supporting back ends of the respective grates, front ends of the respective grates being supported on grates of an adjacent Y-direction row;

a driving member for reciprocating each movable supporting member in the X direction;

bearing means for supporting each movable support member; and said immovable grates and movable grates supported at a predetermined angle of $\theta_1$ relative to a surface of the immovable supporting member.

Thus in accordance with the invention each Y-direction row of grates has a common bearing member by which the grates are supported on a Y-direction axle.

The above objects and other objects and advantages of the present invention will become apparent from the following detailed description, taken in conjunction with the appended drawings.

DESCRIPTION OF THE PREFERRED EMBODIMENT

An example of the present invention will now be described with specific reference to the appended drawings.

Figure 1:
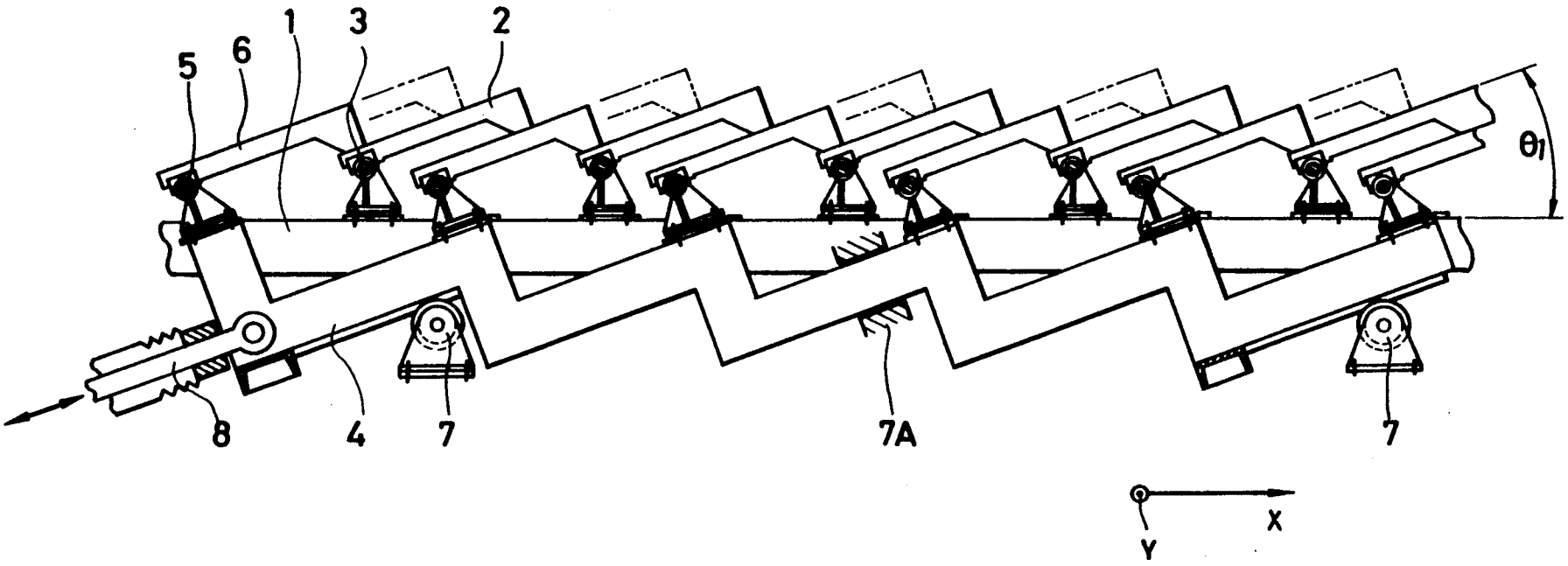
FIG. 1 is an elevation illustrating an assembly of the grates in one example of the present invention.

FIG. 1 is an elevation showing the grates of an incinerator in an example of the present invention.

In FIG. 1, reference numeral 1 denotes a support member located in a position immovable relative to a horizontal type incinerator and arranged in the direction of X which is the longitudinal direction of the incinerator 1. A first set of grates 2 are each arranged to be freely rotational around an axis 3 in a plurality of positions on the support member 1 in the X direction at predetermined intervals.

A movable support member 4 is arranged adjacent to the above-described support member 1 in the Y direction. Said movable support member 4 has a sawtooth form and extends as a whole in the X direction. A movable grate 6 freely rotating around an axis 5 is positioned at the top of each sawtooth. Said movable support member 4 is supported by spaced rollers 7. The grate 6 can be shuttled forward and backward on support 4 at predetermined optional strokes by a driving member 8 attached to support 4.

The grate 2 on the fixed support member 1 and the movable grate 6 on the movable support member 4 are arranged alternately in the X direction. Each of the grates 2 and 6 is supported with an inclination $\theta_1$ of from 10° to 30°, free ends of each of the grates rest on the surface of each adjacent grate. A row of the grates having a plurality of the grates 2 and 6 arranged in the X direction is constituted in this way, and a plurality of such rows of the grates are arranged in the Y direction (in the direction at right angles to the surface of FIG. 1). Each of the grates 2 and 6 is freely rotational on the respective axes 3 and 5.

Figure 2:
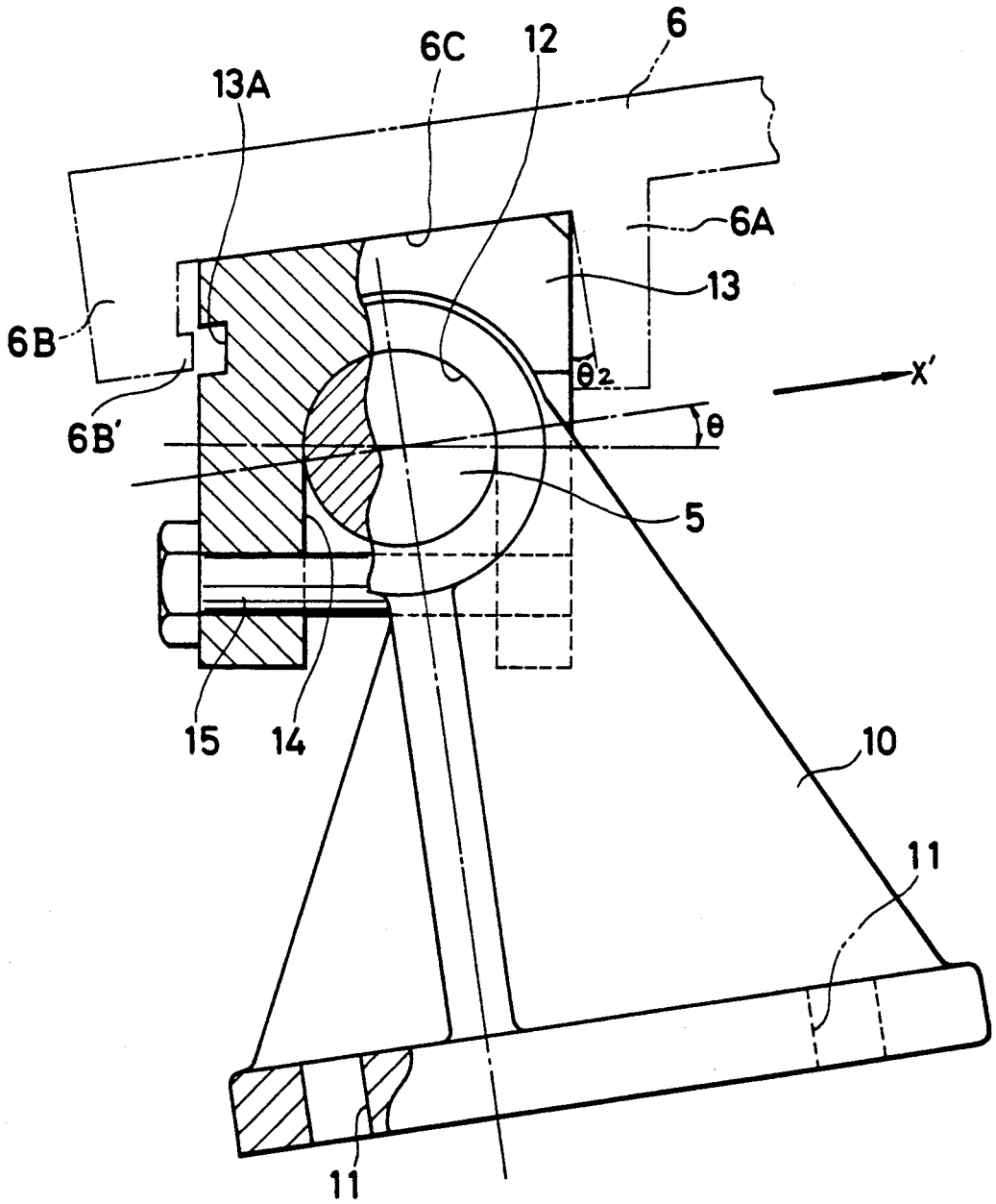
FIG. 2 is an enlarged partially broken away elevation illustrating a bearing member of a grate in FIG. 1 and a portion of a grate adjacent to the bearing member.

In FIG. 2, reference numeral 10 denotes a support to be screwed by a bolt (not shown) in a mounting hole on the movable support member 4 as shown in FIG. 1. A supporting boss 12 is formed on the upper portion of the support 10 to support an axis 5.

The axle 5 common to each of the rows of the grates in the Y direction penetrates the supporting boss 12. Bearing members 13 for all the grates 6 in each Y-direction row of the grates are supported on the axle 5.

The bearing member 13 has a U-shaped groove open downwardly and supported on said axle 5. The groove 14 has a form of a U with steps in the X direction to be mounted on a support at the end of the groove in the direction of Y. A bolt 15 can be threaded across the legs of said bearing member 13 just under the axle 5.

A grate 6 has a recess 6C formed by two protrusions 6A and 6B on the lower face thereof and is supported thereby on said bearing member 13. The recess is engaged with said bearing member 13 on the outer surface of the bearing member 13 which has a polygonal form. The inner surfaces of said protrusions 6A and 6B spaced in the X direction are inclined at an angle of $\theta_2$ of from 5° to 30° to the adjacent surfaces of the bearing member 13. A projection 6B' is formed on the inner surface of the rear protrusion 6B to be engaged with a recess 13A formed on the rear surface of the bearing member 13.

Figure 3:
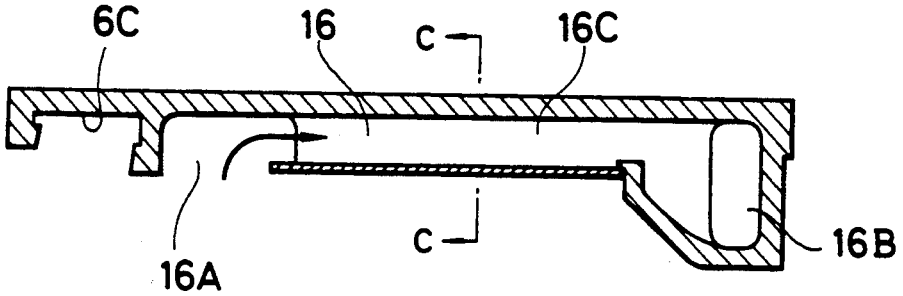
FIG. 3(A) is a sectional view of a grate of FIG. 1.
FIG. 3(B) is a bottom view of the grate in FIG. 1.
FIG. 3(C) is a sectional view of the grate on line C—C in FIG. 3(A).
Figure 3:
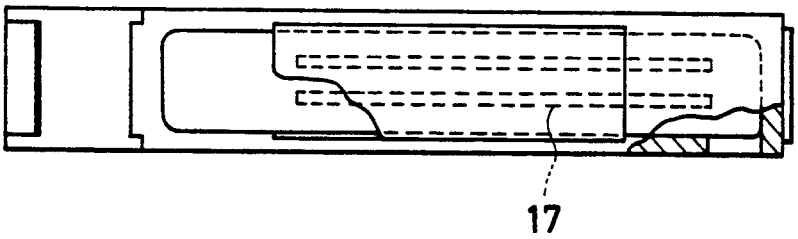
Figure 3:
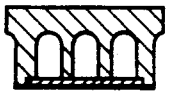

A passage 16 serving as a flow path for cooling air is formed on the lower side of each grate 6 as shown in FIG. 3(A) to (C). The passage 16 has a rear opening 16A in the lower face thereof and a front opening 16B in the lateral face thereof. The intermediate portion of the passage 16 is divided into a plurality of spaces by partition walls 17 extending front and back. Accordingly, the air flow path extends from the rear opening 16A to the front opening 16B via the intermediate portion which is constituted by a plurality of spaces parallel to each other.

The operation of the incinerator will now be described.

Refuse is sent to the front of the grates by moving the movable grates 6 forward and backward by driving the drive member 8 during incineration of the refuse. Then, the lower surfaces of the front ends of the movable grates 6 slide on the upper surfaces of immovable grates 2. In this operation, if attachments adhere to the surfaces of the grates 2, a movement around the axis 5, wherein the front surface of the grate 6 strikes the attachments and rises by getting over the attachments, is generated. Further, a force generated by the drive member 8 with the front end of the grate as the supporting point causes a moment around the front end of the grate, which raises the rear portion (the portion on the bearing member 13) of said movable grate 6, to the movable grate 6. In the prior art grate, the front end of the grate is raised or the rear portion of the grate rises from the bearing member due to the moment. In this example, however, the moment around the axis 5 which causes the rise of of the front end of the grate is received by the bearing member 13 on the polygonal surface of the bearing member 13. However, since said bearing member 13 extends longwise in the Y-direction and supports also the grates in the other rows in one united body, the weight of the grates in the other rows resists to the moment around the above-mentioned axis. In consequence, the front end of the grate 6 does not rise. Relative to the moment around the front end of the grate, since the angle $\theta_2$ is formed on the surface where the the grate 6 is engaged with the bearing member 13, a forward pushing force causes its downward constituent force of the gate 6 when the bearing member 13 presses the grate 6 forward, by which the rear portion of the grate is prevented from rising, resisting to the moment around the front end of the grate. The rear portion of the grate is prevented from rising during the backward movement of the grate 6 due to the engagement of the protrusion 6B' of the grate 6 with the recess 13A of the bearing member and the support by the axis 5 by means of the bolt 5.

Combustion air is supplied from the lower side of the grates 2 and 6. The air flows into the passage 16 through the rear opening 16A of the grate, flows forward through the air flow paths, which are made by dividing the passage and which are parallel with each other, and reaches the front end of the grate. Then, the combustion air flows out through the front opening 16B. Accordingly, the grates are highly effectively cooled and particularly the front end of the grate is uniformly and sufficiently cooled in the direction of the width of the grate. In consequence, it is difficult for the attachments to adhere to the grate.

As described above, according to the present invention, since the front end or the rear portion of the grate is raised or rises due to the attachments during the forward and backward movement of the movable grate, the front end or the rear portion of the grate is prevented from being raised or rising without forming any gap among the grates, by which normal combustion is maintained. This enables the intervals of maintenance, such as the change of the grates, longer. Moreover, since the grate is sufficiently cooled to the front end thereof, attachments do not readily adhere to the grate, which decreases the causes of raising or rising of the grate.

What is claimed is:

1. A grate structure for a horizontal type incinerator, comprising:

a plurality of rows of grates arranged in parallel in perpendicular X and Y directions of the incinerator;

each X-direction row including a plurality of immovable grates in series in the X direction; and a plurality of movable grates arranged in series in the X direction alternating with the immovable grates;

an immovable support member for the immovable grates;

a movable support member for the movable grates;

a bearing member, for each Y-direction row of grates positioned between the grates and an axle extending in the Y-direction and which is common to each of the grates in the Y-direction row, the bearing member and axle supporting back ends of the respective grates, front ends of the respective grates being supported on grates of an adjacent Y-direction row;

a driving member for reciprocating each movable supporting member in the X-direction;

bearing means for supporting each movable support member;

said immovable grates and movable grates supported at a predetermined angle of $\theta_1$ relative to a surface of the immovable supporting member;

said immovable grates and said movable grates being freely rotational around the respective axles; and the grates each having a recess formed by a front protrusion and a rear protrusion on a lower surface of the grate, each said recess engaging the respective bearing member through a polygonal surface on the bearing member.

2. The grate structure of claim 1, wherein said angle $\theta_1$ is from 10° to 30°.

3. The grate structure of claim 1, wherein said protrusions each have an inner face inclined at an angle of $\theta^\circ_2$ to an adjacent surface of the bearing member and said angle $\theta^\circ_2$ is from 5° to 30°.

4. The grate structure of claim 1, wherein said rear protrusion has a projection on an inner surface thereof, said projection being engaged with the concave portion formed on a rear face of the bearing member.

5. The grate structure of claim 1, wherein said movable supporting member is arranged adjacent to said immovable supporting member in the Y direction.

6. The grate structure of claim 5, wherein said movable supporting member has a sawtooth form and a movable grate is freely rotationally mounted around the respective axle on top of each sawtooth.

7. The grate structure of claim 1, wherein the respective axles are mounted on the respective support members by supports screwed onto the support members.

8. The grate structure of claim 1, wherein the bearing member each has a U-shaped groove opened downwardly, said groove being supported on the respective axle.

9. The grate structure of claim 8, wherein said bearing member has opposite legs, spanned by bolts fixed under the respective axle.

10. The grate structure of claim 8, wherein said groove has a form of a U with steps in the Y direction to be mounted on the support at the end of the groove in the Y direction.

11. The grate structure of claim 1, wherein the grates each have a passage providing an air flow path for cooling the grate.

12. A grate structure for a horizontal type incinerator, comprising:

a plurality of rows of grates arranged in parallel in perpendicular X and Y directions of the incinerator;

each X-direction row including a plurality of immovable grates in series in the X direction; and a plurality of movable grates arranged in series in the X direction alternating with the immovable grates;

an immovable support member for the immovable grates;

a movable support member for the movable grates;

a bearing member, for each Y-direction row of grates positioned between the grates and an axle extending in the Y-direction and which is common to each of the grates in the Y-direction row, the bearing member and axle supporting back ends of the respective grates, front ends of the respective grates being supported on grates of an adjacent Y-direction row;

a driving member for reciprocating each movable supporting member in the X-direction;

bearing means for supporting each movable support member;

said immovable grates and movable grates supported at a predetermined angle of $\theta_1$ relative to a surface of the immovable supporting member wherein the grates each have a passage providing an air flow path for cooling the grate, and wherein said passage has a rear opening in a lower face of the grate and a front opening in a lateral face of the grate and the passage is divided internally into a plurality of spaces by partition walls extending forward and backward of the grate, air flowing from the rear opening into the passage, passing through an intermediate portion of the passage including said walls and flowing out of the passage through the front opening.

* * * * *